United States Patent [19]

Andràda Galan et al.

[11] Patent Number: 5,001,954

[45] Date of Patent: Mar. 26, 1991

[54] SEALING SYSTEM FOR A CUTTING TABLE HAVING VACUUM CLAMPING

[75] Inventors: Mario Andràda Galan; Bernardo Alcantara Perez; Narciso Murillo Gonzalez, all of Madrid, Spain

[73] Assignee: Investronica, S.A., Madrid, Spain

[21] Appl. No.: 181,818

[22] Filed: Apr. 15, 1988

[30] Foreign Application Priority Data

Apr. 15, 1987 [ES] Spain ..... 8701109

[51] Int. Cl.[5] ..... B26D 7/02

[52] U.S. Cl. ..... 83/451; 83/952; 198/689.1

[58] Field of Search ..... 83/451, 152, 938, 952, 83/56, 422; 271/276; 198/689.1

[56] References Cited

U.S. PATENT DOCUMENTS

| | | | |
|---|---|---|---|
| 3,765,289 | 10/1973 | Gerber et al. | 83/452 |
| 4,528,878 | 7/1985 | Gerber | 83/56 |
| 4,542,673 | 9/1985 | Pearl | 83/422 |
| 4,572,357 | 2/1986 | Pearl | 198/693 |

*Primary Examiner*—Douglas D. Watts
*Assistant Examiner*—John M. Husar
*Attorney, Agent, or Firm*—Kenyon & Kenyon

[57] ABSTRACT

A vacuum grip cutting table for laminar material of the type having a conveyor loop comprising a plurality of successive tiles is provided with a vacuum sealing device for the tiles at the collection end of the cutting table.

5 Claims, 9 Drawing Sheets

5
5
40
40
60
58
65
64
45
43
50
50
54
55
55
54
68

SEALING SYSTEM FOR A CUTTING TABLE HAVING VACUUM CLAMPING

FIELD OF THE INVENTION

The present invention is directed to a mobile vacuum grip cutting table for textile materials and the like having a vacuum sealing system at the feed end and the collection end of the mobile table.

BACKGROUND OF THE INVENTION

There are innumerable patents in the field of textile cutting or the like using stationary tables and numerical controls. When moving tables were designed to make the material move forward for cutting by sections, vacuum gripping was employed and the problem of sealing to maintain the vacuum clamping led to completely closing the conveyor table converting it into a sealed box with the top part opened. After inserting the material, the box was closed with an airtight material which was normally discarded after the cutting tool had passed. With such a system, the problem of sealing the ends of the cutting table does not arise as they are located within the large vacuum box. Applications of this technology are disclosed, e.g., in Gerber Garment Technology, Inc. Spanish Patent Nos. 520,922; 520,923; and 520,924; and Strumpf U.S. Pat. No. 4,322,993.

One disadvantage of this system is that the vacuum box must be very rugged, since due to the vacuum levels used and the relatively large surfaces, very high force levels result.

Another solution is to create an airtight chamber under the cutting surface, and through horizontal and vertical mechanical valving, to form independent vacuum sections. See, e.g., Gerber Garment Technology, Inc. U.S. Pat. Nos. 4,485,712 and 4,528,878. The complications of using this method with cutting tables results in the solution being frequently rejected for economic reasons.

An alternative solution is to insert some type of discardable panel which cuts the flow horizontally such as that disclosed in Gerber Garment Technology Inc., U.S. Pat. No. 3,765,289. After the cutting knife has passed, the panels are changed as they become ineffective.

U.S. Patent Application Ser. No. 132,999 filed Dec. 15, 1987 entitled "Improved Vacuum Grip Cutting Table", the disclosure of which is incorporated herein by reference, discloses a conveyor table for cutting laminar material. The conveyor table comprises a conveyor loop formed by a plurality of successive adjacent tiles. The cutting surface defined by the tiles located in the upper horizontal conveyor leg comprises a mat which is penetratable by a knife and permeable to air. A vacuum is applied to the mats in the upper horizontal conveyor leg to secure the material to be cut. At the curvature adjacent the material feed end and the material collection end of the upper horizontal conveyor leg, air or vacuum leakage occurs, i.e., air passes from the atmosphere into the vacuum area. This causes the vacuum pump to operate at an excessive flow rate and/or a reduction in the vacuum.

Due to the work cycle of the movable conveyor table, the table advances at a variable pace depending on the configuration to be cut in the material and the location of the material in the cutting work window. Consequently, any closing system at the feed end and collection end of the upper horizontal conveyor leg cannot be limited to two fixed positions, open and closed. The closing system must have the necessary flexibility to adjust to the variable movement and starting and stopping of the conveyor loop.

OBJECTS OF THE INVENTION

It is an object of the present invention to provide an improved vacuum sealing system at the feed end and the collection end of a mobile vacuum grip cutting table for textile materials and the like.

These and other objects of the present invention will become apparent from the following description and claims in conjunction with the drawings.

SUMMARY OF THE INVENTION

The present invention provides a sealing system for a moving vacuum grip cutting table for laminar material of the type comprising a conveyor loop formed from a plurality of successive, adjacent tiles. The tiles each have an air permeable mat surface to define the cutting surface formed by the tiles located in the upper substantial horizontal conveyor leg. A vacuum is applied to the mats of the tiles located in the upper horizontal conveyor leg. The present invention provides a vacuum sealing system at the first conveyor loop curvature located at the feed end of the cutting table and a vacuum sealing system at the second conveyor loop curvature located at the collection end of the feed table.

The vacuum sealing system at the feed end of the cutting table preferably comprises an endless belt mounted near the first conveyor loop curvature which is driven in synchronizism with the conveyor loop. There are a plurality of flexible bands spaced around the endless belt, each flexible band being joined at one end to the endless belt. The flexible bands each have a width at least as great as the width of the mats of the tiles. These flexible bands provide for the vacuum sealing at the first conveyor loop curvature.

The vacuum sealing system at the collection end of the cutting table is suitably a flexible endless belt mounted on two idler axles. The development of this endless belt is greater than the distance between the two idler axles whereby the endless belt adheres to the mat of the tile immediately adjacent to the beginning of the second loop curvature providing the vacuum sealing. This endless belt has a width at least as great as the width of the mats of the tiles.

The vacuum sealing system at the collection end of the cutting table may suitably be a band having a width at least as great as the width of the mats. Means are provided to make this band taut or slack. When the band is taut, the band is removed from the upper surface of the mats when the conveyor moves. When the band is slack, it adheres to the upper surface of the mats providing the vacuum sealing. A bar is provided to cause the band, when slack, to adhere to the front surface of the mat of the tile immediately adjacent the start of the second loop curvature.

BRIEF DESCRIPTION OF THE DRAWINGS

In the drawings forming part hereof.

DETAILED DESCRIPTION

Figures 1, 1A:
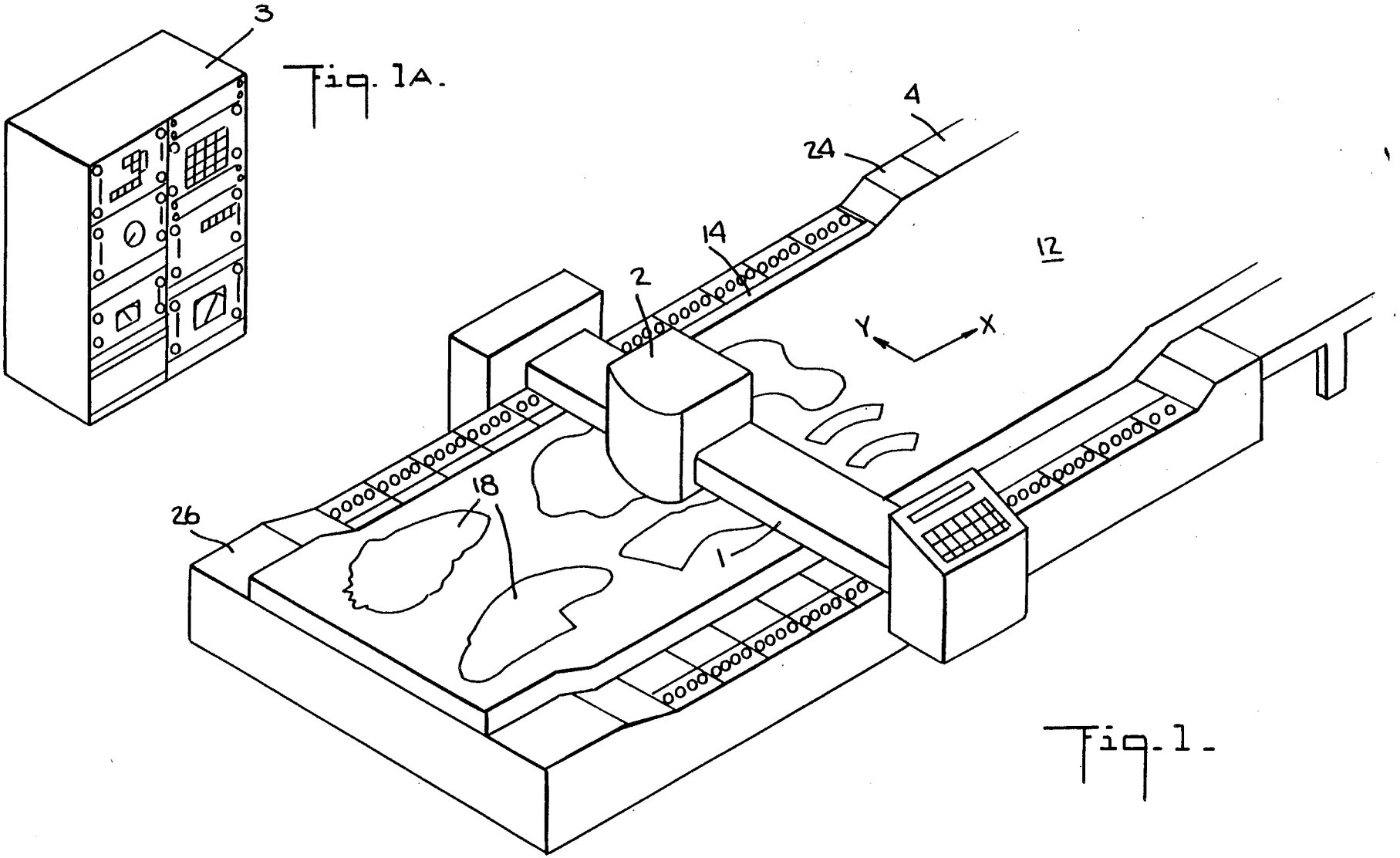
FIG. 1 is a schematic view of a vacuum grip cutting table with which the present invention ma be employed.
FIG. 1A illustrates a controller unit for the vacuum grip cutting table of FIG. 1.

FIG. 1 is a schematic view of a vacuum grip cutting table with which the present invention may be employed. A pile of laminar material 12, such as textile material, is fed from a flattening table 4 through a coupling 24 and is moved forward by a conveyor 14. The cut parts 18 are removed at the collection area 26 or adjacent thereto. The geometry of the cut is achieved by suitably moving a bridge I (carriage "X") and "Y" carriage 2. A controller 3 (FIG. 1A) regulates these movements by driving the motors of the X and Y carriages. Carriage "Y" carries a cutting tool suitable for the material being worked on.

Figure 2:
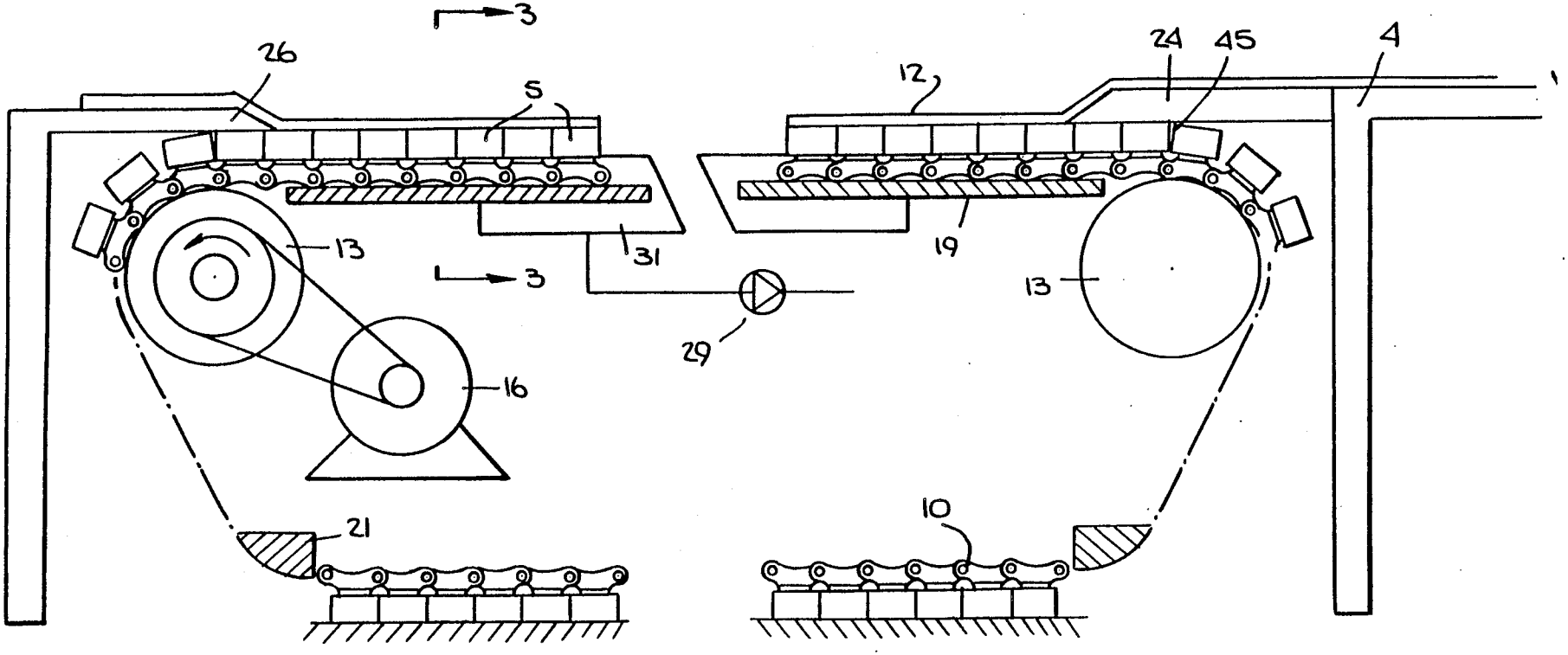
FIG. 2 diagrammatically, partially in section, illustrates in side view a conveyor loop with which the present invention may be employed.

FIG. 2 diagrammatically illustrates a conveyor table on which the material 12 to be cut runs and rests. The material 12 to be cut runs and rests on the upper substantially horizontal conveyor leg between the feed end 24 and the collection end 26. The X - Y carriages and the controller are not illustrated in FIG. 2 for reasons of clarity.

The conveyor loop comprises a plurality of adjacent tiles 5 joined to the links of chain lo. Links of chain 10 enmesh wheels 13 one of which (left hand wheel 13 in the illustrated embodiment) is coupled to motor 16 which generates the motion of the conveyor loop. The chain 10 is further guided by straight guides 19 and curved guides 21 to define the conveyor loop. The laminar material 12 is supplied by the coupling 24 (feed end) from the flattening table 4, and once cut, is removed at the collection area 26. The material being fed first contacts the conveyor 14 at a feed zone and is removed from the conveyor 14 by a collection comb.

During the cutting process, the material 12 has to be secured to the top surface of the upper horizontal conveyor leg between the feed end and the collection end. This is accomplished by vacuum generated by vacuum pump 29 connected in fluid communication with central suction pipe 31. This stationary suction pipe 31 communicates the vacuum to the tiles 5 through relevant openings. A detailed description of this vacuum system may be found in the aforementioned U.S. Pat. Application Ser. No. 132,999 filed Dec. 15, 1987.

Figure 3:
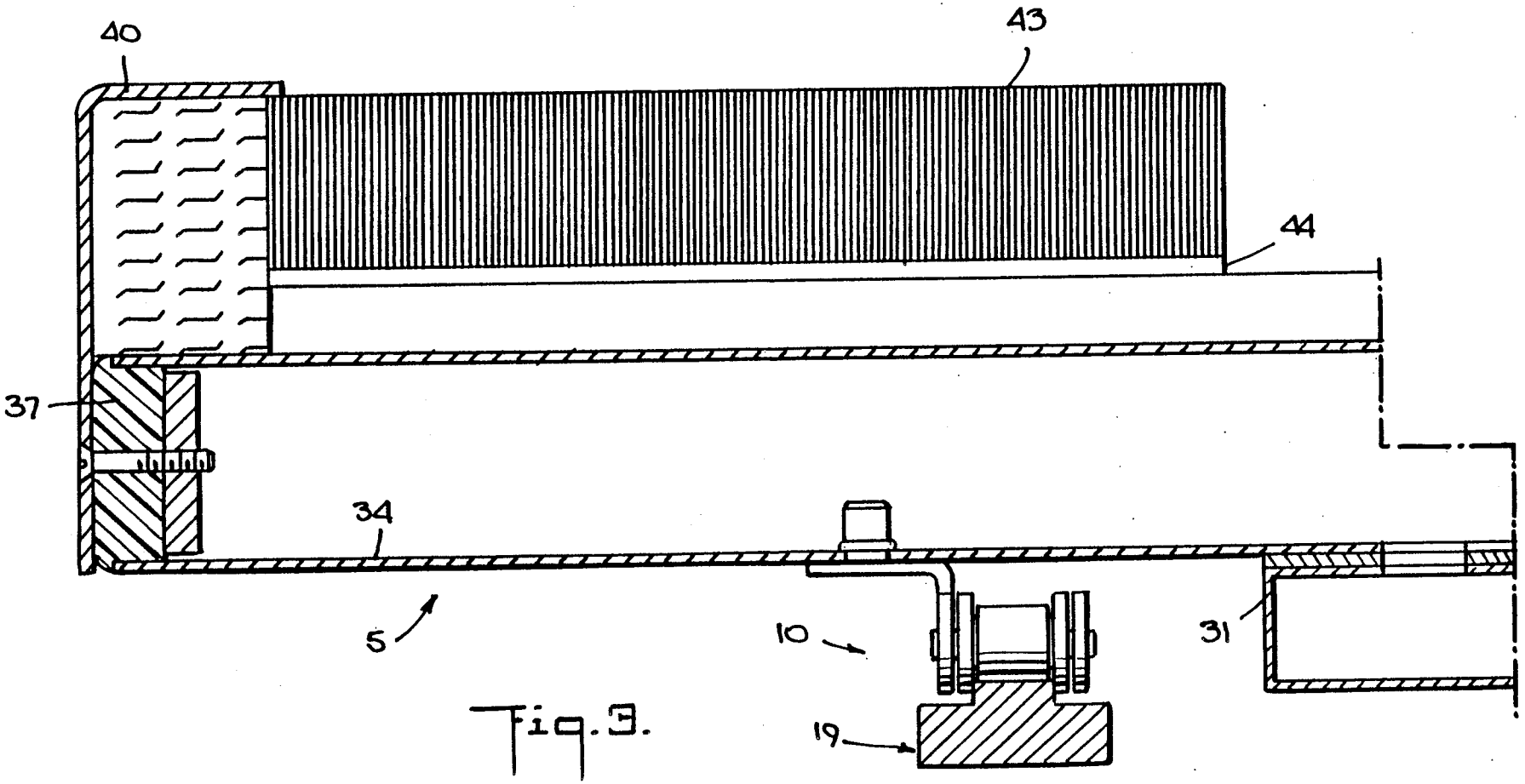
FIG. 3 is a cross-sectional view along line 3—3 of FIG. 2 illustrating a tile 5 of the conveyor loop of FIG. 2.

FIG. 3 is a cross-sectional view along line 3—3 of FIG. 2 illustrating a tile 5 formed by a hollow tube 34 closed at its ends by caps 37 and plates 40. The vacuum from stationary central suction pipe 31 passes to hollow tube 34 of tile 5 and from hollow tube 34 to mat 43 mounted on the top of hollow tube 34. The base 44 of mat 43 is permeable to air. The material 12 to be cut rests on the prongs forming the mat 43 (see FIG. 2) and hence is secured by the vacuum (difference in pressure). For a detailed description of the closing or sealing between adjacent tiles 5 of the conveyor loop, see the aforementioned U.S. Pat. Application Ser. No. 132,999 filed Dec. 15, 1987.

With reference to FIG. 2, it can be seen that once vacuum is communicated to the tiles 5, the vacuum is communicated horizontally through the prongs of the mats 43. The tops of the mats 43 are closed at the top by the material 12. The sides are closed by plates 40. Vacuum leakage through the bottom is prevented by gaskets 70 (See FIG. 5). Location 45 (See, e.g., FIG. 2) remains the sole area of communication of the vacuum with the outside. The present invention is directed to prevention of-communication of the vacuum with the outside or atmospheric pressure at locations 45.

Figure 4:
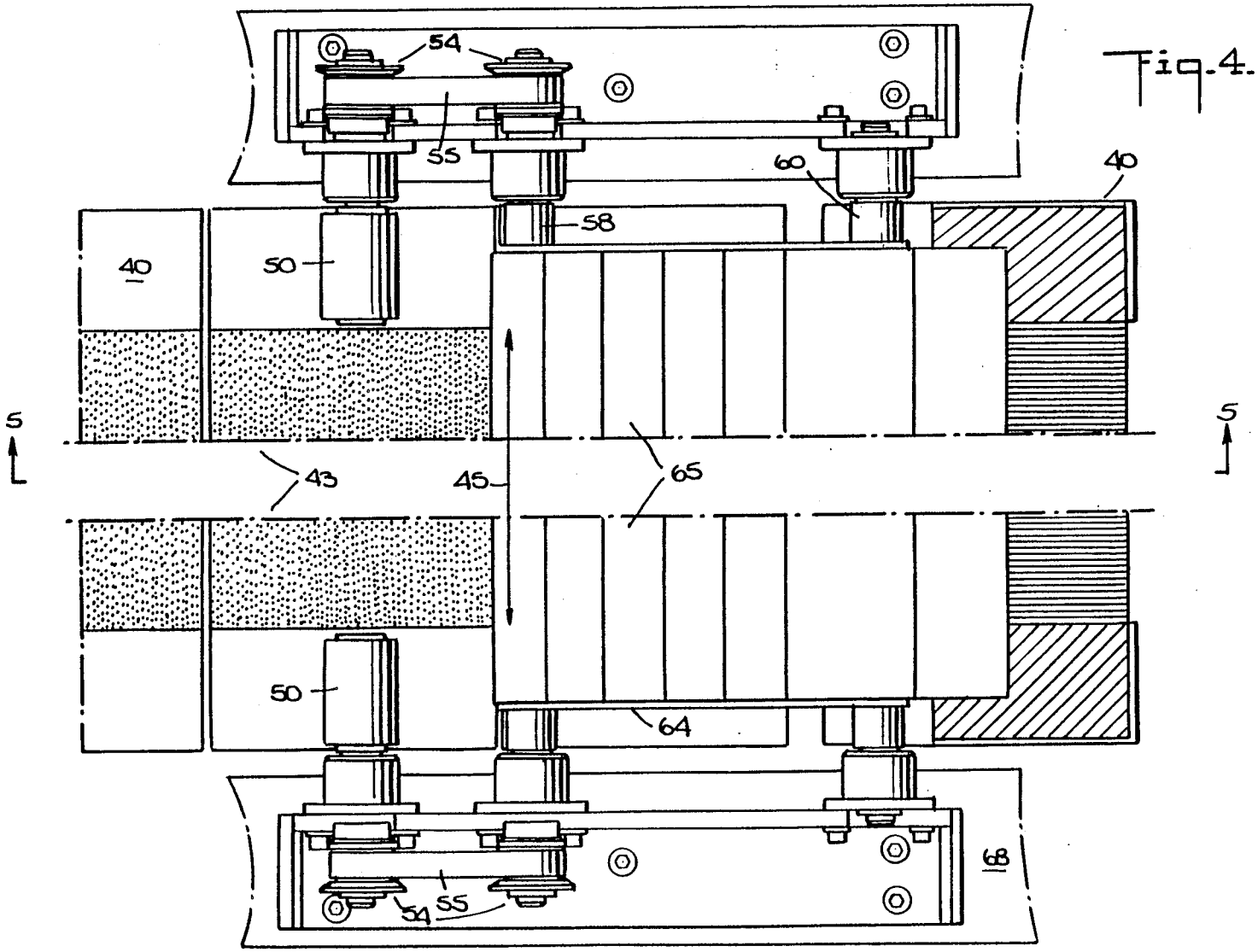
FIG. 4 illustrates a plan view of a sealing system in accordance with the present invention, at the feed end of the cutting table, with the cover removed.

FIG. 4 illustrates a plan view, in accordance with the present invention, at the feed end 24 with the cover removed.

Rollers 50 roll on the end plates 40 of the tiles 5 when the conveyor loop moves. Movement is transmitted to the axle 58 through equal pulleys 54 and belts 55. See also FIG. 5. An endless belt 64 is placed between axle 58 and another axle 60. Multiple bands 65 are fastened by one of their edges to belt 64. The width of these bands is slightly greater than the width of the mat 43 area, i.e., they cover the width of the open front 45. The bands 65 also have a length sufficient to cover the vertical face 46 of mats 43 at open area 45. See FIG. 5. The diameter of the axle 58 in contact with the belt 64 is equal to that of the roller 50, whereby a linear displacement speed of the endless belt 64 equal to that of the conveyor table is obtained.

The necessary brackets are also illustrated in FIG. 4 for fixing the axles and transmissions to the fixed structure of the table 68. Axles 58 and 60, the roller 50 and the endless belt 64 can also be seen in FIG. 5. The gaskets 70 can prevent vacuum leakage downwards between hollow tubes 34 of adjacent tiles 5 can be seen in FIG. 5.

Figure 5:
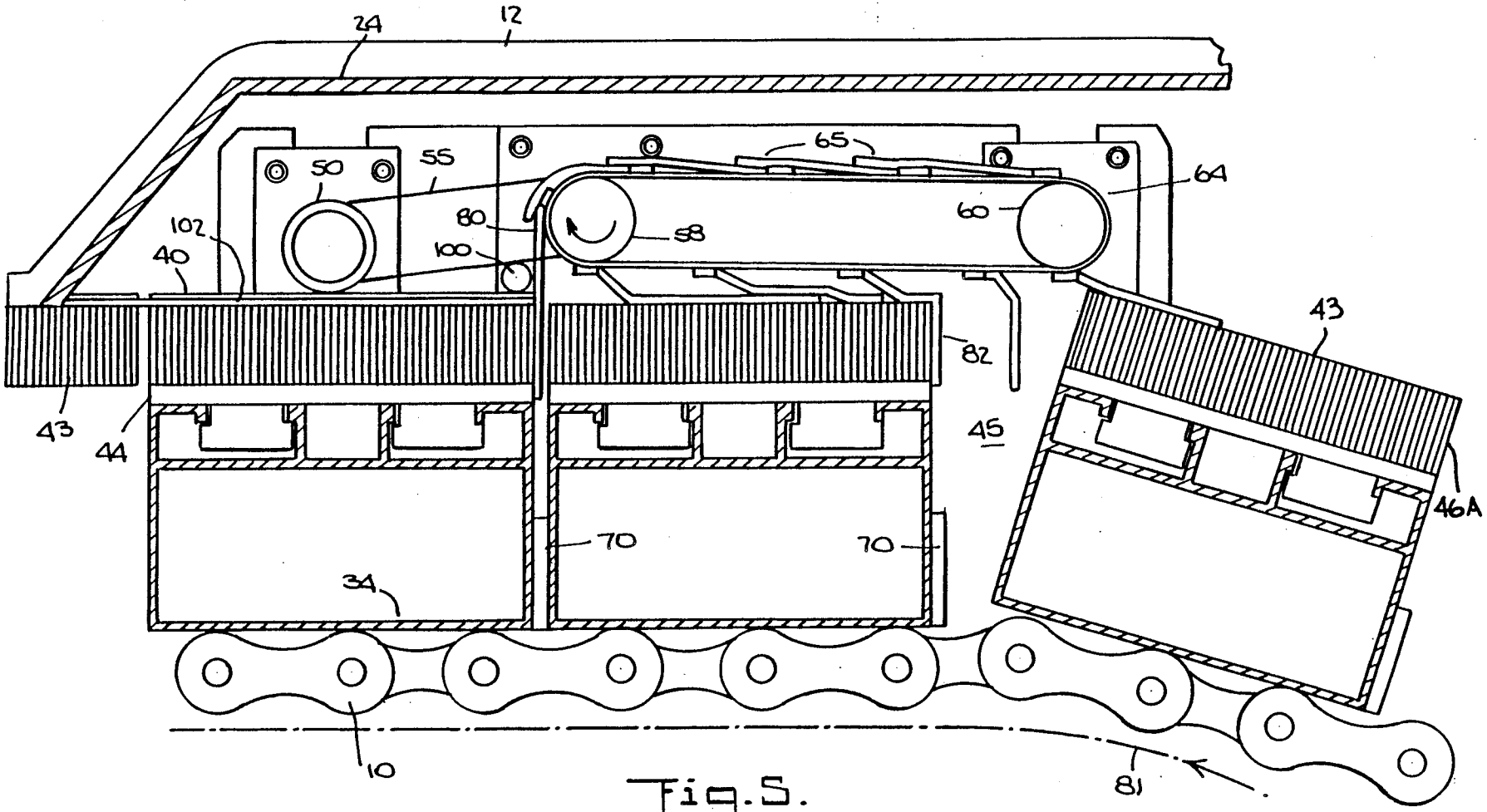
FIG. 5 is a cross-sectional view along line 5—5 of FIG. 4.

In the layout illustrated in FIG. 5, one of the bands 65 which is specified by 80 closes the face 46 of the mat 43, being adhered to it by vacuum. The width of these bands is sufficient to close all the face surface 46 open to the atmosphere. As the system moves in the direction indicated by 81, the band 80 tends to go upwards by the movement transmitted through the roller 50 and belt 55 to the axle 58, but when it does so, the communication of the vacuum to the next tile will ensure that it is the band 82 which closes the face surface 46 and in subsequent steps it will occupy the position now occupied by 80, thereby establing an uninterrupted closing system, which guarantees the horizontal sealing of the machine.

The bands placed in the bottom part of the belt 64 and included between 80 and 82 prevent leakage through the top of the mat. The mat area under the frame 24, not closed by the aforementioned bands 65 is blocked by a band 102 fixed by the support pipe 100 to the structure closely adjacent to roller 58. The other end of band 102 may be free. This band 102 rubs the mats 43 of tiles 5 when the table is moving and always adheres to it by vacuum. Outside the feed end frame 24, it is the fabric 12 which prevents leakage through the upper surface.

Figure 6:
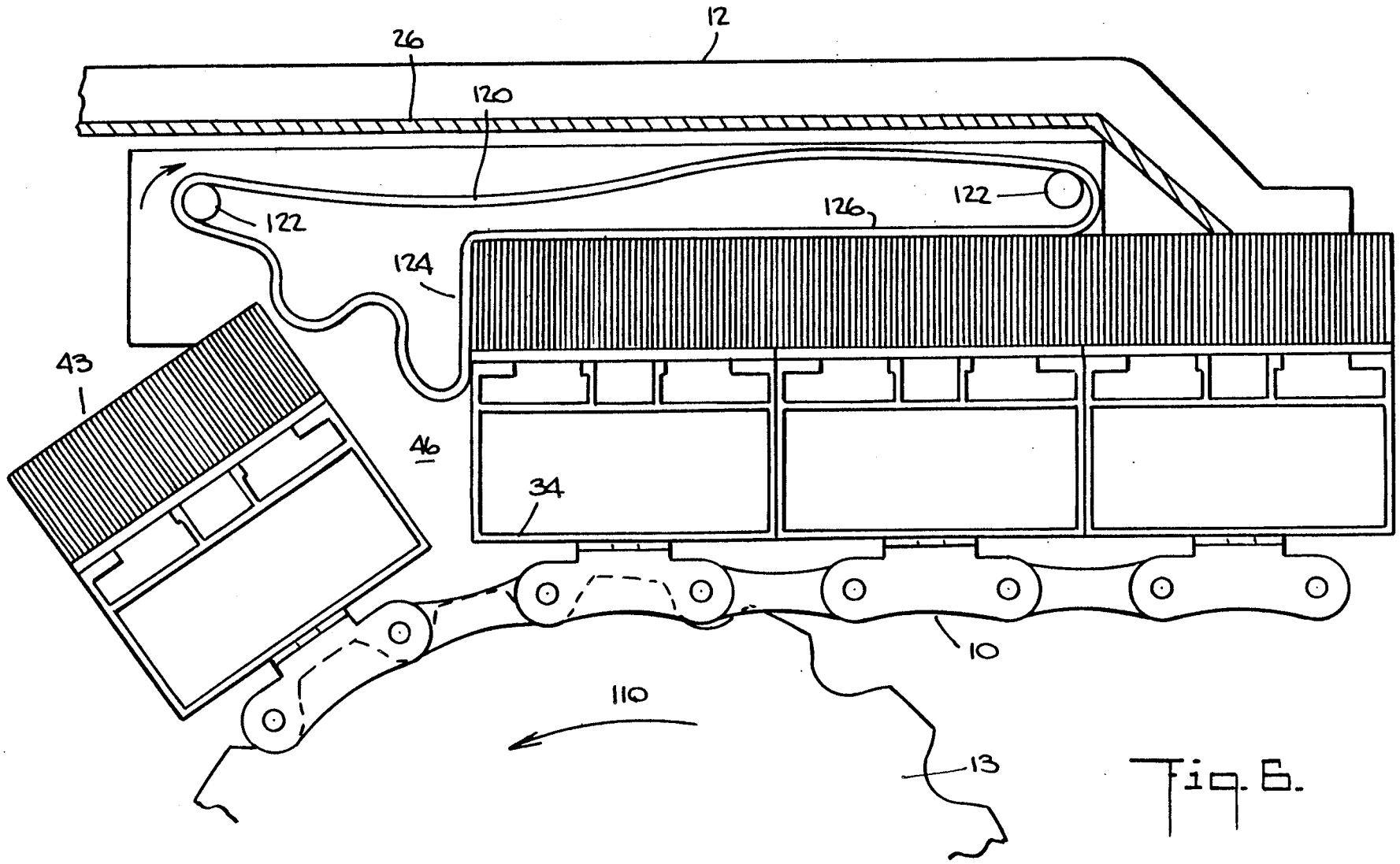
FIG. 6 is a side view of a sealing system, in accordance with the present invention, at the collection end of the cutting table.

FIG. 6 illustrates the sealing system for the collection area 26 which moves in the direction indicated by arrow 110. The situation of the chain 1 and tiles 5 is symmetric to that illustrated in FIG. 5, except that the wheel 13 is the drive wheel. Under the collection end frame 26, there is the endless belt 120 with its rollers 122. In the position shown, it is the front vertical face 124 of the mat 43 which is closed with the belt 120 adhering thereto, as well as on the upper part 126, thus sealing the assembly. As illustrated, the development of the belt 120 is greater than the distance between rollers 122, thus permitting the sealing action.

Figure 7:
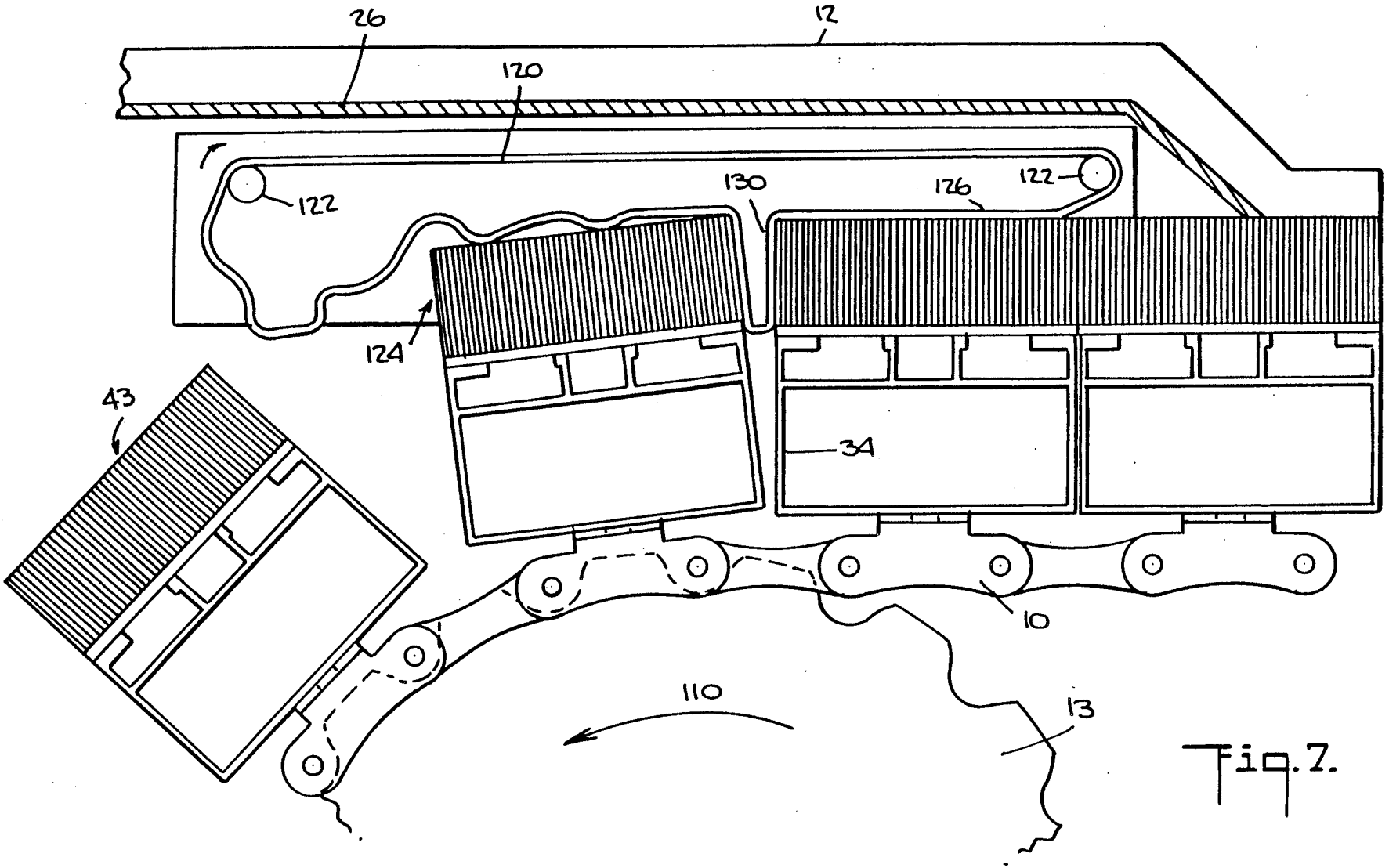
FIG. 7 is a view similar to FIG. 6 after the moving cutting table has moved forward a selected distance.

FIG. 7 illustrates a situation following that shown in FIG. 6; it is now the front vertical face 130 which is blocked and a more reduced upper surface 126 than before. The rest of the belt 120 is slack. Belt 120 suitably has a width at least equal to the width of mats 43.

Figure 8:
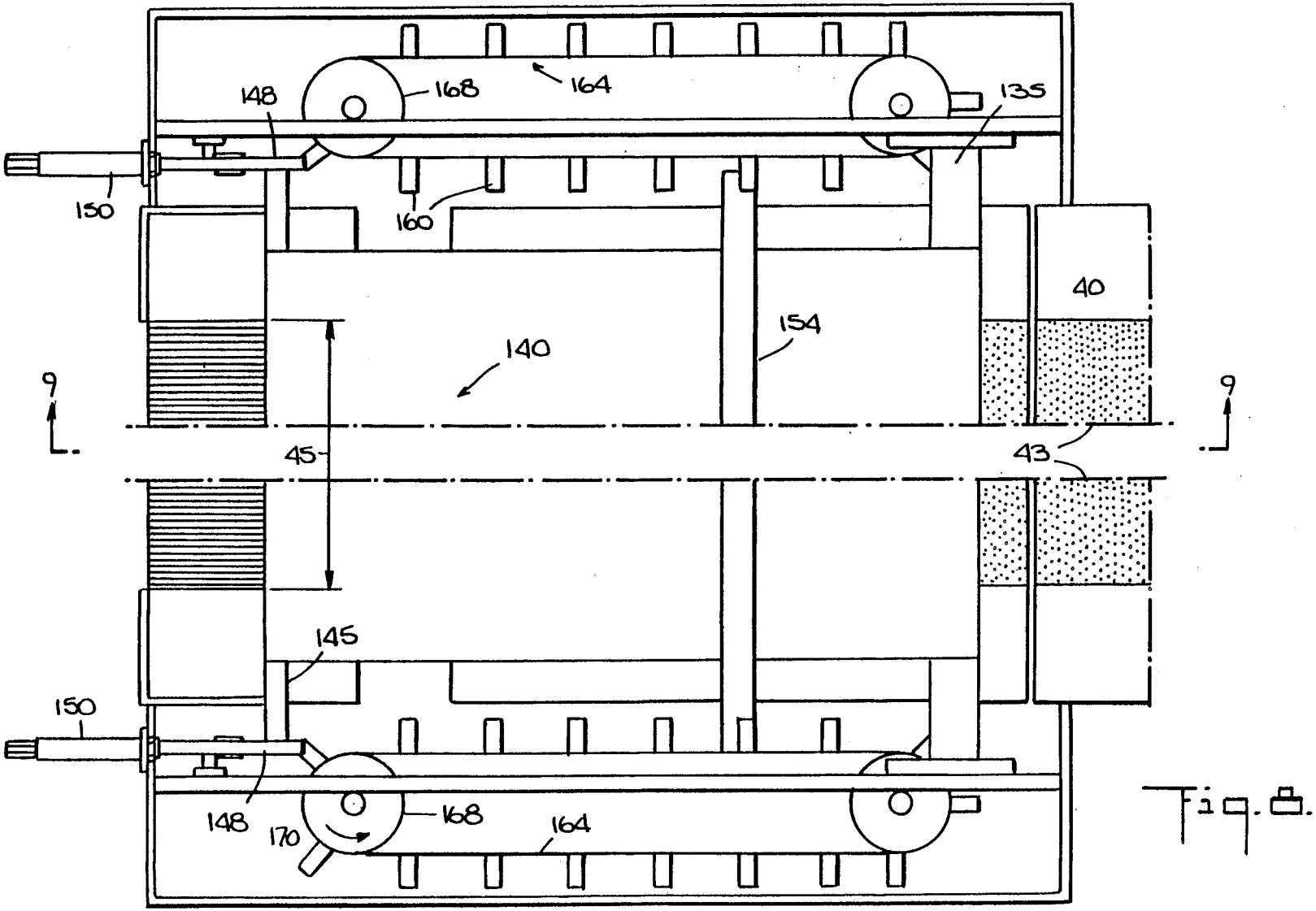
FIG. 8 is a plan view of another embodiment of the sealing system of the present invention at the collection end of the cutting table, with the cover removed.

FIG. 8 illustrates another preferred embodiment for the sealing system at the collection end and is a plan view with the frame 26 removed. Anchored to the bracket 135, there is a belt 140 slightly wider than the leakage area 45, corresponding to the mats 43.

The other end of the belt 140 is secured by a pipe 145 which is connected to connecting rods 148 which are moved by the cylinders 150. The bar 154 which runs on the belt 140 and the mats 43 to enter the first opening it finds, makes a horizontal sweep pushed by the stubs 160 of the belts 164. Pulleys 168 which turn in the direction illustrated by 170, move the belts 164, these pulleys being mechanically or electronically synchronized.

Figure 9:
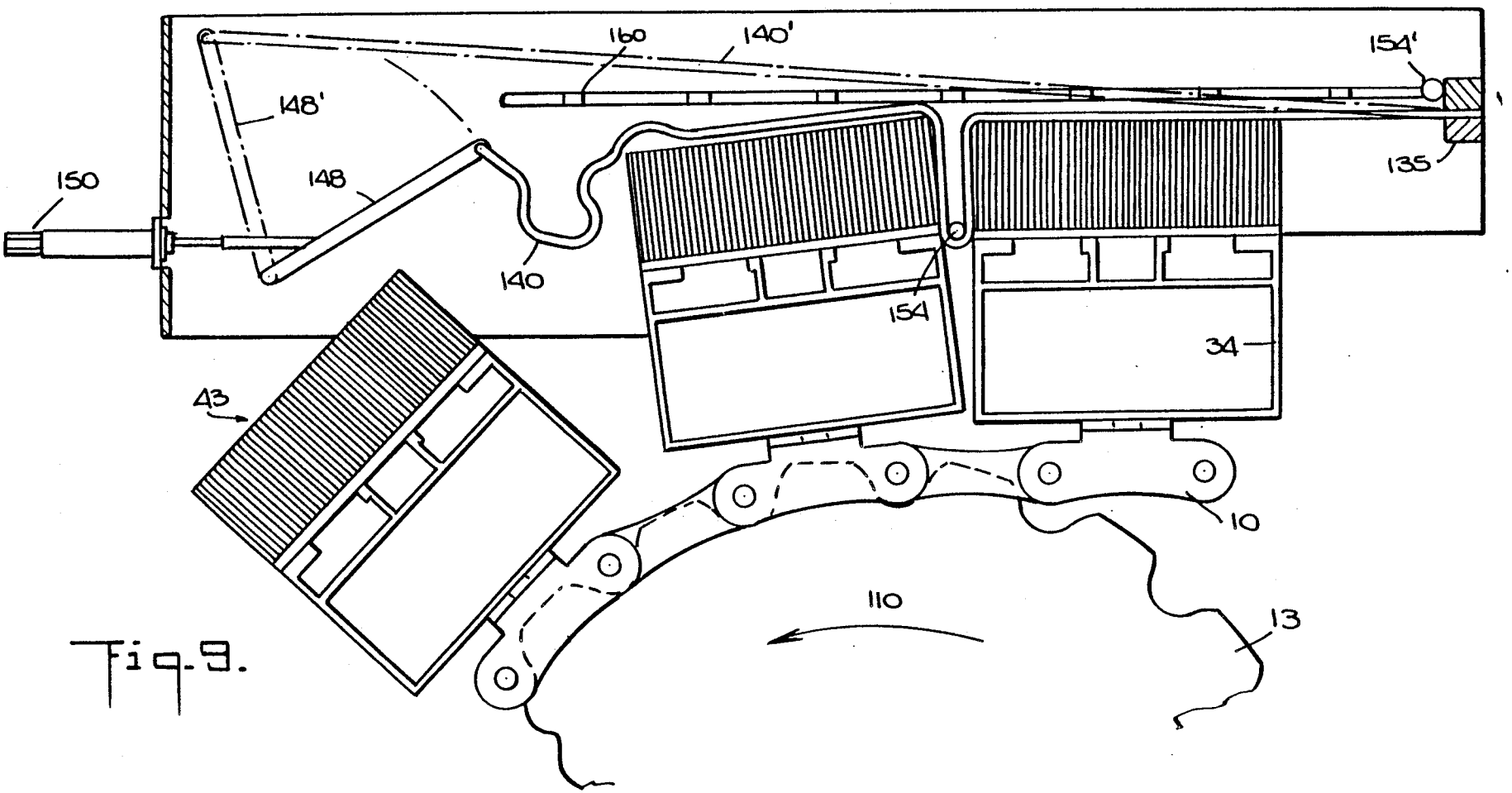
FIG. 9 is a cross-sectional view along line 9—9 of FIG. 8.

FIG. 9 shows the two working positions of the sealing system illustrated in FIG. 8. During the cutting process, when the table is at a standstill, the connecting rod 148 driven by the cylinder 150 leaves the belt 140 slack and the bar 154 forces the belt 140 into the opening. The bar 154 has moved forward towards the opening, being pushed by the stubs 160.

To move the table forward, the connecting rod occupies position 148', tightening the belt 140, and making the bar move back to 154', so that there is no interference with the tiles 5 in their movement. The interference of the bar 154 in its run towards 135 with the stubs 160 has to occur on a flat surface of the mat 43 where there is no possible opening, so that the first appreciable opening is found by the bar in its sweep pushed by the stubs 160.

Although preferred embodiments of the present invention have been described in detail, it will be appreciated that modifications may be by one skilled in the art all within the spirit and the scope of the present invention as defined in the claims.

What is claimed is:

1. A sealing system for a moving vacuum grip cutting table for laminar material, said cutting table comprising:

a conveyor loop mounted for movement in a stationary table, said stationary table comprising a frame, a feed end having a feed zone, and a collection end having a collection comb and a collection area for supporting received laminar material, said conveyor loop having an upper substantially horizontal leg for transporting the material to be cut;

said upper horizontal conveyor leg having a first end located at the feed end of said stationary table and a second end located at the collection end of said stationary table;

means for driving said conveyor loop such that said upper horizontal conveyor leg moves from said feed end to said collection end;

a first conveyor loop curvature next to the first end of said upper horizontal conveyor leg;

a second conveyor loop curvature next to the second end of said upper horizontal conveyor leg;

said conveyor loop being formed by a plurality of successive, adjacent tiles, each tile having a mat surface permeable to air;

means for producing a vacuum in the mate of the adjacent tiles defining the upper horizontal conveyor leg;

movable means for vacuum sealing at least the mat of the tile in the upper horizontal conveyor leg at said second end immediately adjacent said second conveyor loop curvature when said conveyor loop is stationary during material cutting, said movable means for vacuum sealing being disposed below said collection area.

2. A sealing system according to claim 1 wherein said movable means for vacuum sealing further includes means for withdrawing sealing contact with said mat when said conveyor loop moves.

3. A sealing system according to claim 1 wherein said movable vacuum sealing means at said second end of said upper horizontal conveyor leg comprises a band having a width perpendicular to the direction of movement of said conveyor loop at least as great as the width of said mats, said band having a first end stationarily mounted to said table frame closely adjacent to said collection comb of the collection end of said stationary table; said band having a second mobile end located near said second conveyor loop curvature; and means connected to said second mobile end for making said band taut thereby separating said band from said mat adjacent said second conveyor loop curvature when said conveyor loop moves and for making said band slack thereby adhering said band to said mat adjacent said second conveyor loop curvature when said conveyor loop is stationary during material cutting.

4. A sealing system according to claim 2 further comprising an additional movable means for vacuum sealing at least the mat of the tile in the upper horizontal conveyor leg at said first end immediately adjacent said first conveyor loop curvature when said conveyor loop is stationary during material cutting.

5. A sealing system according to claim 4 wherein said additional movable means for vacuum sealing further includes means for withdrawing sealing contact with said mat when said conveyor loop moves.

* * * * *